United States Patent [19]

Matuo et al.

[11] Patent Number: 5,025,238

[45] Date of Patent: Jun. 18, 1991

[54] ELECTROMAGNETIC RELAY

[75] Inventors: Ken-iti Matuo; Muneo Nakata; Mitukazu Hori; Isaji Tanihara, all of Nagano, Japan

[73] Assignee: Omron Tateisi Electronics Co., Kyoto, Japan

[21] Appl. No.: 508,494

[22] Filed: Apr. 12, 1990

Related U.S. Application Data

[63] Continuation of Ser. No. 334,631, Apr. 7, 1989, abandoned.

[30] Foreign Application Priority Data

| | | | |
|---|---|---|---|
| Apr. 7, 1988 | [JP] | Japan | 63-86156 |
| Apr. 8, 1988 | [JP] | Japan | 63-86628 |
| May 13, 1988 | [JP] | Japan | 63-63138[U] |

[51] Int. Cl.[5] ..... H01H 67/02

[52] U.S. Cl. ..... 335/128; 335/83

[58] Field of Search ..... 335/78–84, 335/106–107, 128, 124, 202

[56] References Cited

U.S. PATENT DOCUMENTS

| | | | |
|---|---|---|---|
| 4,020,434 | 4/1977 | Jaegle et al. | 335/78 |
| 4,309,682 | 1/1982 | Arnoux et al. | 335/92 |

*Primary Examiner*—Leo P. Picard
*Assistant Examiner*—Lincoln Donovan
*Attorney, Agent, or Firm*—Fish & Richardson

[57] ABSTRACT

An electromagnetic relay, comprising: a electromagnet consisting of an iron core and a solenoid wound thereon; a yoke extending in parallel with the electromagnet and attached to one end of the iron core; an armature pivotally attached to a part of the yoke adjacent to another end of the iron core at its base end; a fixed contact unit provided adjacent to the electromagnet; an pivotally supported moveable contact carrier; an extension arm extending from the armature and having a free end adapted to abut an actuation point of the moveable contact carrier located between its pivoted point and a moveable contact piece carried thereby; the moveable contact piece being adapted to cooperate with a fixed contact member provided in the fixed contact unit. The lever ratio achieve by the moveable contact carrier permits the magnetic gap between the armature and the iron core to be reduced, and the actuation stroke of the contact mechanism to be increase, in a relative sense, so that the magnetic efficiency can be increased and the reliability of the contact mechanism can be ensured.

14 Claims, 11 Drawing Sheets

FIG. 6
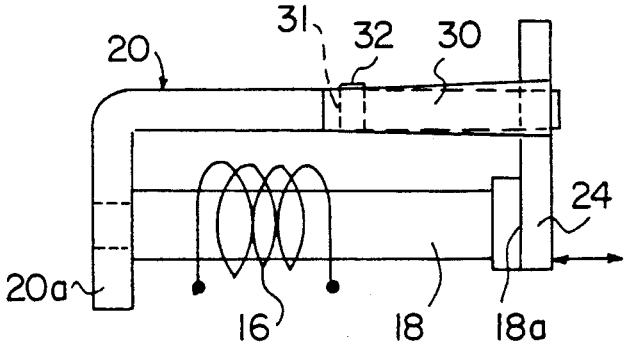
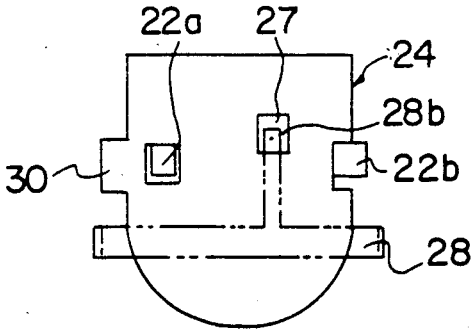
FIG. 7

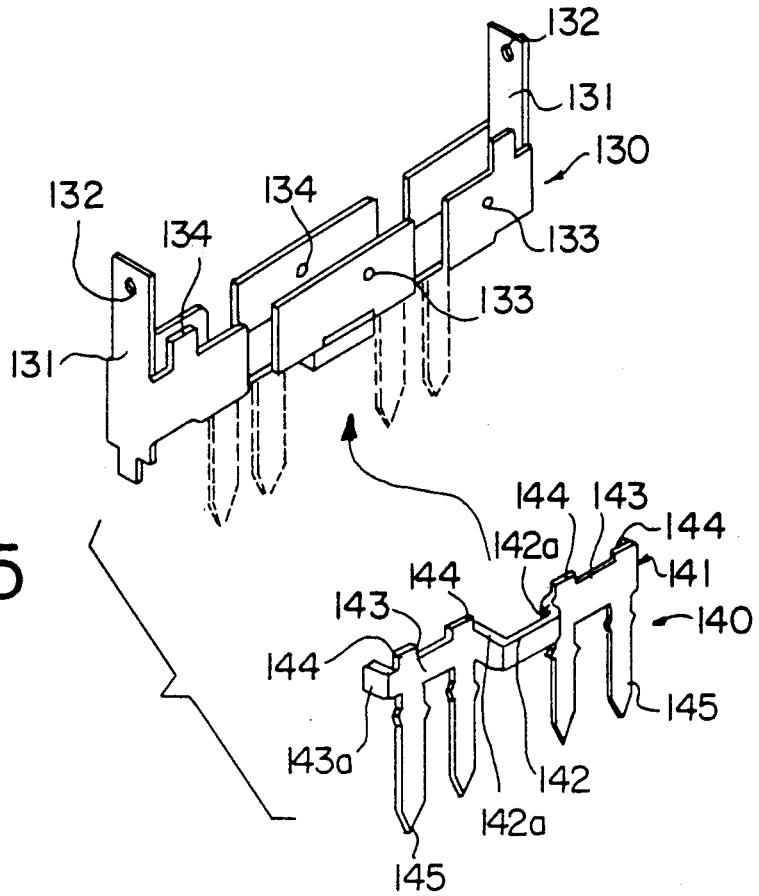
FIG. 15
FIG. 16
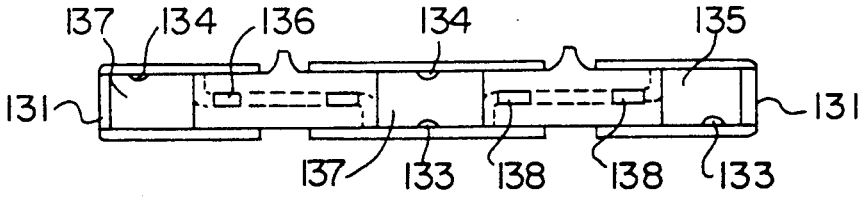
FIG. 17
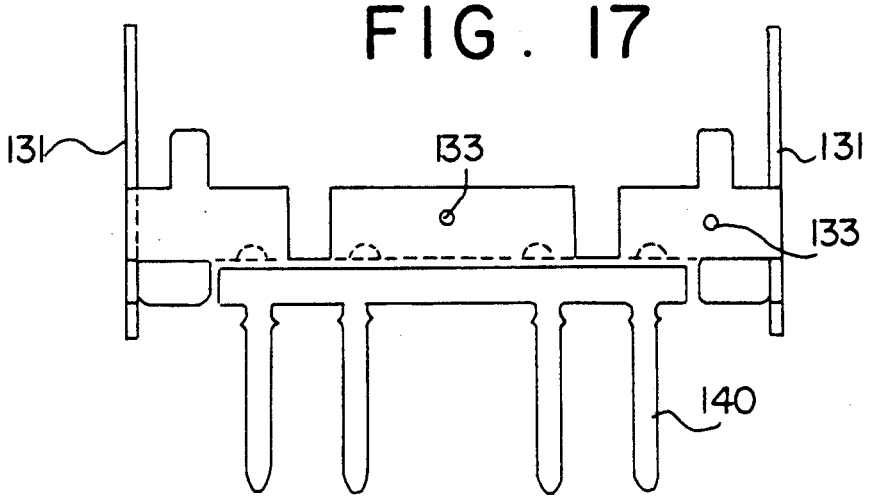

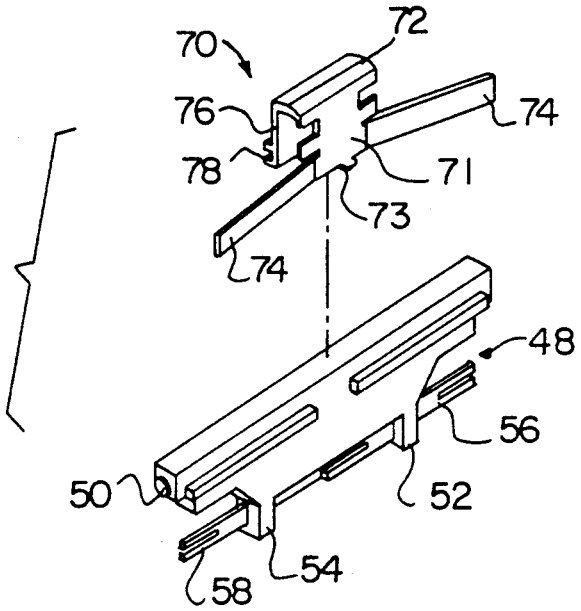
FIG. 19
FIG. 20
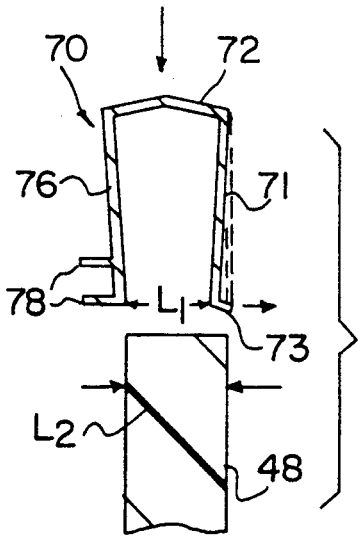
FIG. 21
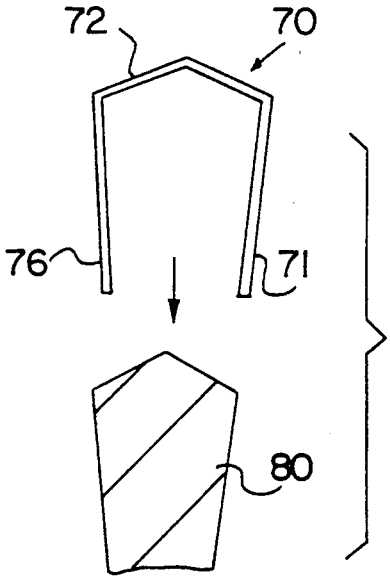

ELECTROMAGNETIC RELAY

This application is a continuation of U.S. application Ser. No. 07/334,631, filed Apr. 7, 1989, now abandoned.

TECHNICAL FIELD

The present invention relates to an electromagnetic relay which is compact and highly sensitive owing to its novel structure of its yoke and armature, and in particular to such an electromagnetic relay which is suitable for controlling high frequency electric current.

BACKGROUND OF THE INVENTION

An electromagnetic relay generally comprises an iron core having solenoid wound thereon, a yoke connected to the iron core at its one end so as to define a magnetic gap therebetween, an armature hinged to the yoke so as to be driven in the direction to close the magnetic gap when the solenoid is energized, a spring member urging the armature away from closing the magnetic gap, a contact mechanism, and transmission means for converting the displacement of the armature to that for actuating the contact mechanism.

In such an electromagnetic relay, since the magnetic gap is desired to be minimized so as to produce a maximum attractive force between the iron core and the armature and a certain actuation stroke is required for reliable actuation of the contact mechanism, it is desirable to attain a fairly large lever ratio or transmission ratio with the transmission means. However, to attain a large lever ratio, the size of the transmission means, for instance, consisting of a lever mechanism tends to be increased beyond an acceptable limit.

The lever ratio may be increased by using a longer lever, but this will increase the size of the electromagnetic relay. Therefore, it is desired to increase the lever ratio substantially without increasing the size of the electromagnetic relay. It is conceivable to achieve this goal by providing a notch in the yoke for receiving a lever arm extending from the armature so as to curb the increase in size by thus receiving the lever arm within the general contour of the yoke while ensuring a sufficient length to the arm, but the resulting diminution of the width of the yoke may reduce the mechanical strength of the yoke to an unacceptable level. In particular, susceptibility of the yoke to deformation makes its handling extremely troublesome particularly in the case of small electromagnetic relays. Further, reduction in the cross sectional area of the yoke increases the magnetic resistance of the yoke which forms a part of a magnetic circuit and the magnetic efficiency of the magnetic circuit tends to be impaired. It means an increased power consumption and a reduced sensitivity.

Electromagnetic relays for high frequency current requires a shield structure for its contact pieces. Therefore, assembly work tends to be highly troublesome and it has been desired to design a highly compact structure for high frequency electromagnetic relays which is easy to assemble. In particular, the shield case must be a highly enclosed structure in order to achieve a high isolation capability, but this in turn causes an increase in the manufacturing cost and the possibility of thermal deformation during the process of soldering lead wires to the ground terminals integrally provided in the shield case. Also, the shield case is desired to be manufactured by a simple stamping process for reducing manufacturing cost.

As contact structures for an electromagnetic relay of the aforementioned type, there are known the cross bar contact structure in which a moveable contact member and a fixed contact member both consisting of planar pieces contact each other by a line, and the rivet contact structure in which a planar piece and a hemishperical projection contact each other by a point. The cross bar structure has the disadvantage that the contact tends to be unstable and a sufficient contact pressure may not be attained. On the other hand, the rivet contact structure can ensure a sufficient contact pressure, but since the contact is made by a point, in case of any slight defect in the contact area, the state of contact becomes poor and, therefore, durability and reliability may not be sufficient.

BRIEF SUMMARY OF THE INVENTION

In view of such problems of the prior art and the above described considerations, a primary object of the present invention is to provide an electromagnetic relay which ensures a sufficient actuation stroke for its contact mechanism without increasing the magnetic gap or, in other words, the drive stroke of the armature.

A second object of the present invention is to provide an electromagnetic relay which can be made highly compact without cutting away excessive amount of the yoke for providing the room for movement of an actuation arm extending from the armature for the purpose of magnifying the stroke of the armature as the stroke is transmitted to the contact mechanism.

A third object of the present invention is to provide an electromagnetic relay which is highly durable and reliable.

A fourth object of the present invention is to provide an electromagnetic relay which is easy to assemble.

A fifth object of the present invention is to provide an electromagnetic relay having a favorable shield structure for its contact mechanism.

These and other objects of the present invention can be accomplished by providing: an electromagnetic relay, comprising: a electromagnet consisting of an iron core and a solenoid wound thereon; a yoke extending in parallel with the electromagnet and attached to one end of the iron core; an armature pivotally attached to a part of the yoke adjacent to another end of the iron core at its base end; a fixed contact unit provided adjacent to the electromagnet; an pivotally supported moveable contact carrier; an extension arm extending from the armature and having a free end adapted to abut an actuation point of the moveable contact carrier located between its pivoted point and a moveable contact piece carried thereby; the moveable contact piece being adapted to cooperate with a fixed contact member provided in the fixed contact unit.

The lever ratio achieve by the moveable contact carrier permits the magnetic gap between the armature and the iron core to be reduced, and the actuation stroke of the contact mechanism to be increase, in a relative sense, so that the magnetic efficiency can be increased and the reliability of the contact mechanism can be ensured.

If the extension arm extends from a side end of the armature, and the extension arm comprises a horizontal part extending from the armature in parallel with the electromagnet, and a vertical portion extending laterally from a free end of the horizontal portion toward the electromagnet, a free end of the vertical portion adapted to abut the actuation point of the moveable contact carrier provided on a side of the yoke opposite to the iron core, and the yoke being provided with a notch extending from a side end of thereof so as to accommodate the vertical portion of the extension arm therein without interfering therewith, an additional increase in the lever ratio in the transmission of displace from the armature to the moveable contact carrier can be achieved without increasing the external contour of the electromagnetic relay. Preferably, the yoke is provided with a cut away portion which is narrower than other part of the yoke adjacent thereto so as to accommodate the horizontal part therein without interfering therewith.

According to a preferred embodiment which is suitable for controlling high frequency electric current and has a favorable spatial layout, the moveable contact carrier is pivotally supported by a shield case for the fixed contact member and the moveable contact member. Since the moveable contact member is typically made of synthetic resin material and requires a separate spring member for return action, it is preferred if the moveable contact carrier is provided with a return spring assembly comprising a spring retainer adapted to be fitted upon an end portion of the moveable contact carrier adjacent to its pivotal center line, and a leaf spring piece extending therefrom and abutting a part cf the shield case.

According to this arrangement, the friction between the actuating end of the extension arm and the point of contact at the spring retainer may be reduced by providing that the spring retainer is provided with a projection adapted to be engaged by the actuating end of the extension arm.

According to a preferred embodiment of the present invention, a hemispherical contact is formed in a side wall of the shield case, and the moveable contact piece is provided with a bifurcated end which is adapted to contact the hemispherical con&act at two points.

According to such a structure, since the moveable contact piece contacts the fixed contact member by its bifurcated portion resting upon the hemispherical projection, a double point contact is established therebetween. Thus, a higher contact pressure can be attained as compared with the cross bar contact structure, and, by adoption of the double point contact, reliability may be doubled as compared with the rivet type contact structure which is based on a single point contact.

According to a preferred embodiment of the structure for securing the electromagnet assembly to the base of the electromagnetic relay, the shield case is provided with a tang which is adapted to be fitted into a corresponding hole provided in the yoke, and a terminal piece which is adapted to be passed through a base and fixedly secured thereto, and the solenoid is provided with a pair of coil wire end terminals which are adapted to be passed through the base and fixedly secured thereto, and are provided with engagement portions for holding the electromagnet upon the base.

To the end of electric breakdown of the insulation for the solenoid, the insulation distance may be increased by providing a pair of cavities in the parts of the yoke adjacent to longitudinal end portions of the solenoid.

To simplify the manufacture and assembly of the shield case and to prevent the thermal deformation of the shield case when soldering lead wires to the ground terminal pieces integrally provided with the shield case, according to an alternate preferred embodiment of the present invention, the shield case consists of a outer casing having a surrounding wall, and a plurality of ground terminal pieces which are joined at their base ends by vertical wall portions, the ground terminal pieces being passed through openings provided in the bottom wall of the shield case.

According to a preferred embodiment for simplifying the assembly of the moveable contact carrier to the shield case, the shield case is provided with a pair of upright pieces having pivot holes therein for receiving projections provided in lateral ends of the moveable contact carrier in a pivotal manner, and the moveable contact carrier is additionally provided with guide projections for pushing apart the upright pieces while the upright pieces are provided with openings adjacent to the pivot holes for receiving the guide projections without interfering pivotal movement of the moveable contact carrier; and/or the return spring assembly is provided with a C-shaped spring retainer which is adapted to be fitted onto an end of a planar part of the moveable contact carrier, the C-shaped spring retainer being provided with a roof-top shaped top wall, and an opening defined between two side walls of the spring retainer being narrower than the thickness of a corresponding end portion of the planar part of the moveable contact carrier on which the spring retainer is to be fitted.

BRIEF DESCRIPTION OF THE DRAWINGS

Now the present invention is described in the following in terms of specific embodiments with reference to the appended drawings, in which:

FIGS. 6 and 7 are schematic side and end view of the first embodiment;

FIG. 15 is an exploded perspective view of an alternate embodiment of the shield case according to the present invention;

FIGS. 16 and 17 are a plan view and a side view of the shield case of FIG. 15;

FIG. 19 is an exploded perspective view of an alternate embodiment of the moveable contact carrier assembly according to the present invention;

FIG. 20 is an enlarged schematic sectional view of the moveable contact carrier assembly of FIG. 19; and FIG. 21 is a schematic view showing how the return spring retainer of FIGS. 19 and 20 may be formed.

DETAILED DESCRIPTION OF THE PREFERRED EMBODIMENTS

FIGS. 1 through 13 illustrate an embodiment of the electromagnetic relay according to the present invention. This electromagnetic relay comprises a base 10 consisting of electrically insulating material such as synthetic resin, and a box shaped cover 12 which can be placed upon the base 10 so as to define an enclosed space for accommodating the electromagnetic relay mechanism.

Figure 8:
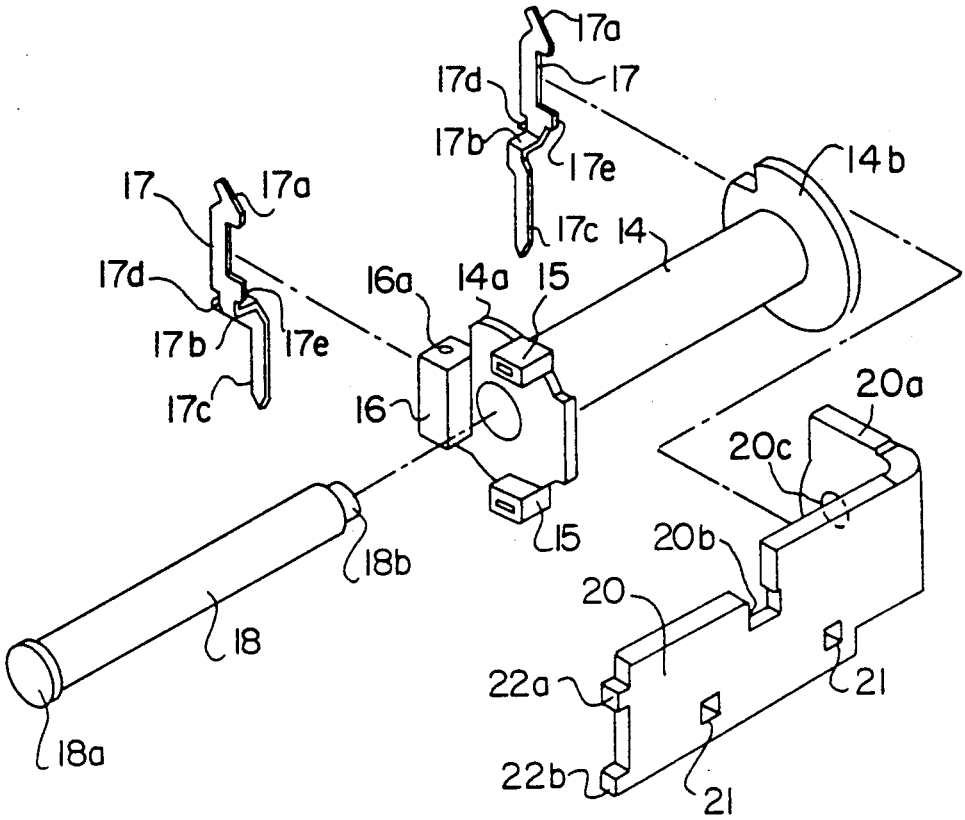
FIG. 8 is an exploded perspective view of the solenoid assembly of the first embodiment.

The base 10 carries thereon an electromagnet assembly comprising a bobbin 14 made of synthetic resin material and consisting of a cylindrical and hollow main part and a pair of radial flanges 14*a* and 14*b* provided on either axial end thereof, a solenoid 16 wound around the outer circumferential surface of the main part of the bobbin 14, a rod-shaped fixed iron core 18 passed through the center of the main part of the bobbin 14, and an L-shaped yoke 20 comprising a main part extending in parallel with the iron core 18 and a bent portion 20*a* bent perpendicularly from the main part thereof and is provided with an opening 20*c* for press fitting or crimping an end 18*b* of the fixed iron core 18 (FIG. 8).

Figure 5:
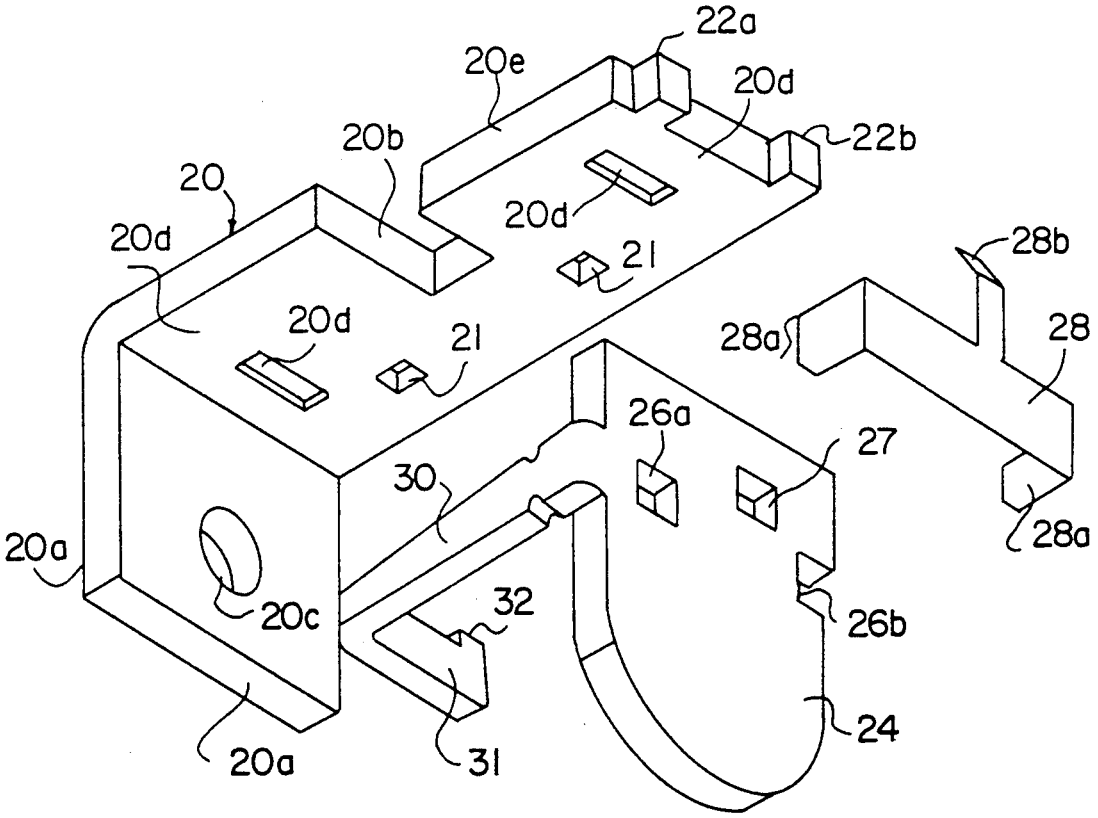
FIG. 5 is a schematic exploded view of the yoke, the armature and the return spring of the first embodiment.

A free end portion of the yoke 20 is provided with a pair of hinge projections 22*a* and 22*b*, spaced along the edge of the yoke 20, which loosely fit into a hinge hole 26*a* and a hinge notch 20*b* both provided in an armature 24 as best shown in FIG. 5. Thus, the armature 24 can pivot around a pivotal axial line defined by the engagement between the hinge projections 22*a* and 22*b* and the hinge hole and notch 26*a* and 26*b* in the manner of a hinge as indicated by the arrow A in FIG. 1. Further, a T-shaped leaf spring 28 is securely attached to one of the flanges 14*a* at its two lateral legs 28*a* which are press fitted into corresponding holes provided in blocks 15 formed in the same flange 14*a*, and a front leg 28*b* of this T-shaped leaf spring 28 is engaged with another opening 27 provided in the armature 24 at a point intermediate between the hinge hole 26*a* and the hinge notch 27 and laterally spaced from the line passing through the hinge hole 26*a* and the hinge notch 27 away from the iron core 18. Thus, the armature 24 is held in position by the leaf spring 28 and is at the same time urged by the leaf spring 28 to pivot away from the opposing end portion 18*a* of the iron core 18. As one skilled in the art can readily understand, the armature 24 and the opposing end portion 18*a* of the iron core 18 defines the magnetic gap of this electromagnet assembly.

The armature 24 is integrally provided with an extension arm 30 extending perpendicularly from a side end of the armature 24, in parallel with the electromagnet assembly. A free end portion of this extension arm 30 comprises bent portion 31 extending approximately toward the iron core 18, and a lateral side surface of this bent portion is defined as an actuating end 32 of this extension arm 30 (see FIGS. 1 and 5). The main part of the yoke 20 is provided with a lateral notch 20*b* extending from one side of thereof adjacent to the actuating end 32 of the extension arm 30. The side end 20*e* of the yoke 20 extending between the notch 20*b* and the hinge end of the yoke 20 provided with the hinge projections 22*a* and 22*b* is set back as compared with the corresponding side end of the yoke extending between the notch 20*b* and the bent portion 20*a* of the yoke 20. In other words, the yoke 20 defines an L-shaped space with the notch 20*b* and the end surface 20*e* within the general contour of the yoke 20.

The solenoid 16 is covered by insulating tape 16*b*, but the coil wire 16*a* tends to be exposed at the longitudinal end portions since the insulation tape 16*b* may not closely meet the flanges 14*a* and 14*b*, and part of the coil wire 16*a* may be exposed to the yoke 20. Therefore, according to the present embodiment, a pair of cavities 20*d* are provided in the parts of the yoke 20 where the end portions of the solenoid 16 oppose the yoke 20 in the closest proximity. By providing the cavities 20*d*, the insulation distance is increased, and the insulation breakdown of the solenoid 16 may be prevented.

Figure 14:
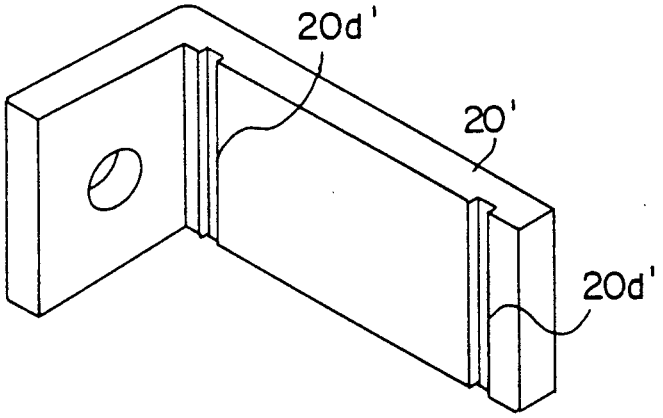
FIG. 14 is an alternate embodiment of the yoke according to the present invention.

FIG. 14 shows an alternate embodiment for increasing the breakdown voltage of the solenoid. According to this embodiment, the cavities 20*d*′ extend all the way across the yoke 20′ and the cavities 20*d*′ may be more easily formed by simple machining.

Figure 9:
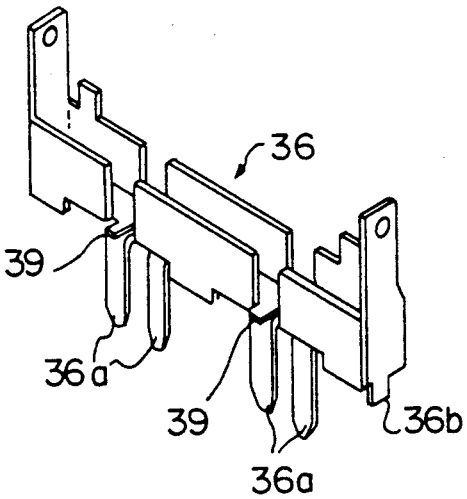
FIG. 9 is a perspective view of the shield case for the contact mechanism of the first embodiment.
Figure 10:
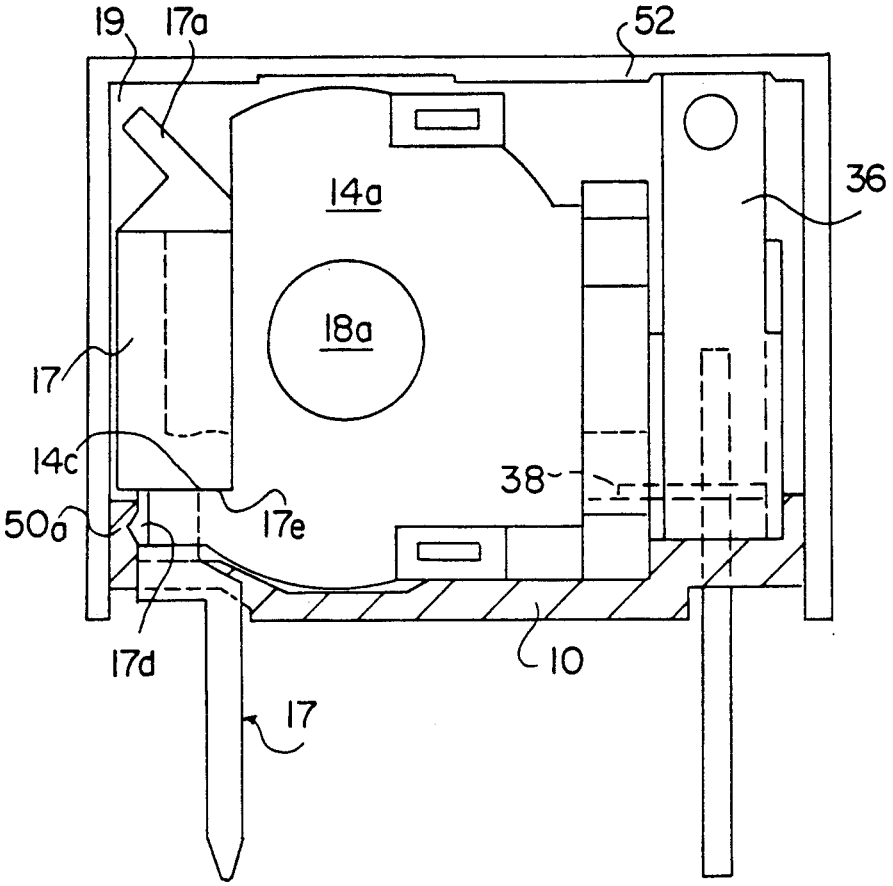
FIG. 10 is a cross sectional view of the first embodiment showing the structure for securing the solenoid assembly.

Referring to FIGS. 8 and 9, the flanges 14*a* and 14*b* of the bobbin 14 are provided with blocks 16 having slits 16*a* for securing solenoid terminal pieces 17 therein. Each of the solenoid terminal pieces 17 is provided with an upper end 17*a* for attaching one of the coil wire ends, a shoulder piece 17*b* adapted to rest upon an upper surface portion of the base 10, a lead portion 17*c* which is passed downwardly through the base 10 for connection to external wiring, a projection 17*d* adapted to be securely engaged with a notch 10*a* provided in the base 10 when the terminal piece 17 is passed all the way through the base 10 as far as it can go, and a tang 17*e* which holds down an upwardly facing shoulder surface 14*c* of the bobbin flange 14*a*. The base 10 additionally carries thereon a shield case 36 which is described hereinafter along the solenoid assembly in parallel therewith. As shown in FIG. 9, this shield case 36 is provided with a pair of tangs 39 extending laterally therefrom so as to be engaged with rectangular holes 21 provided in the main part of the yoke 20, in addition to lead portions 36*a* which are passed through the base 10. Further, the shield case 36 is provided with crimping tangs 36*b* at its either longitudinal end so as to be received in corresponding holes (not shown in the drawings) and crimped thereto by being bent. Thus, the solenoid assembly is secured in position by the coil terminals 17 and the shield case 36 which are in turn secured to the base 10 and provided with the lead portions 17*c* and 36*a*, respectively, which are passed through the base 10.

Figure 11:
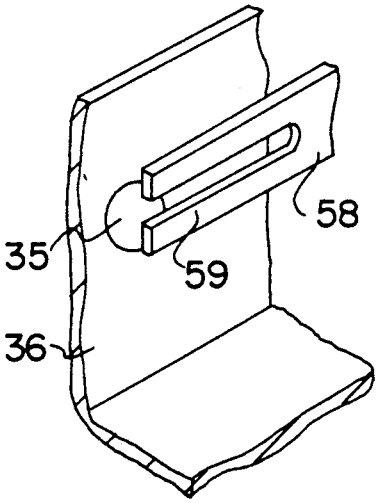
FIG. 11 is a fragmentary perspective view of one of the fixed ground contacts and the corresponding bifurcated moveable contact piece.
Figure 12:
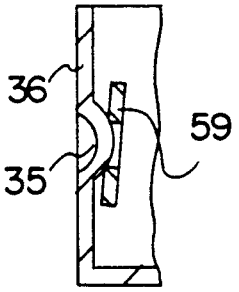
FIG. 12 is a sectional view of the ground contact and the bifurcated moveable contact piece.
Figure 13:
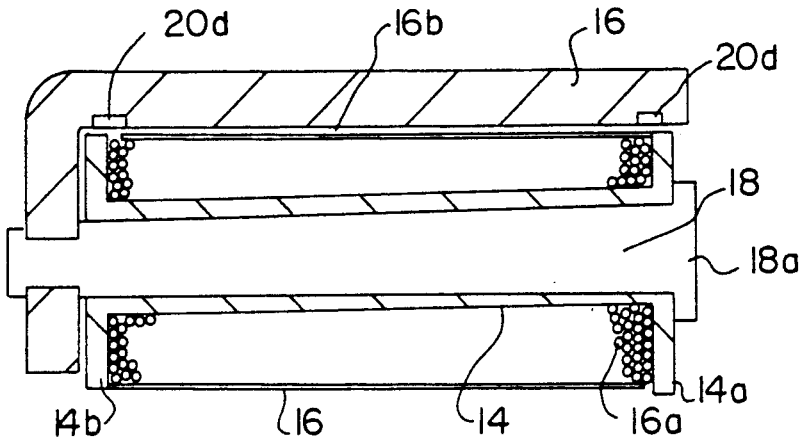
FIG. 13 is a longitudinal sectional view of the solenoid assembly.

Three terminal pieces 38*a*, 40*a* and 42*a* are passed through the base 10, and their upper ends extending into the interior of the shield case 36 form a central, common fixed contact member 38, a normally open fixed contact member 40, and a normally closed fixed contact member 42 while their lower ends are formed as the terminals pieces 38*a*, 40*a* and 42*a* for external wiring purpose. These fixed contact members 38, 40 and 42 are arranged on a common line. Further, two pairs of ground contacts 34 and 35 are formed in the side walls of the shield case 36 as hemispherical projections as best shown in FIGS. 11 and 12.

The shield case 36 is provided with a pair of upright pieces 44 on either longitudinal end thereof, and each of these upright pieces 44 is provided with a pivot hole 46 aligned on a common axial line. These pivot holes 46 receive axial projections 50 provided on either side of a moveable contact carrier 48 constructed as a rotary member consisting of a plate member made of electrically insulating material such as synthetic resin so that the moveable contact carrier 48 may swing round the common axial line of the pivot holes 46.

Figure 1:
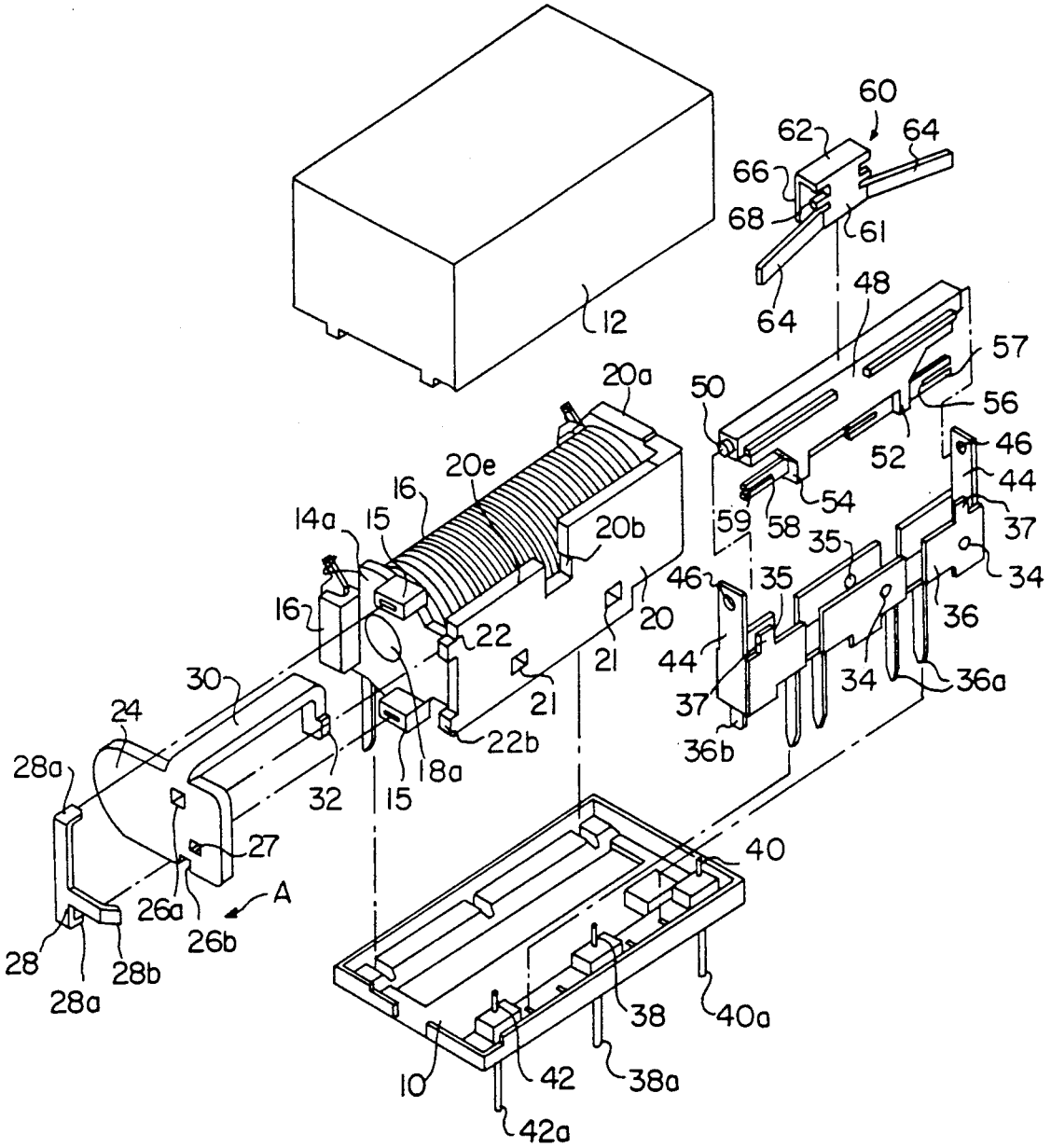
FIG. 1 is an exploded perspective view of a first embodiment of the electromagnetic relay according to the present invention.
Figure 2:
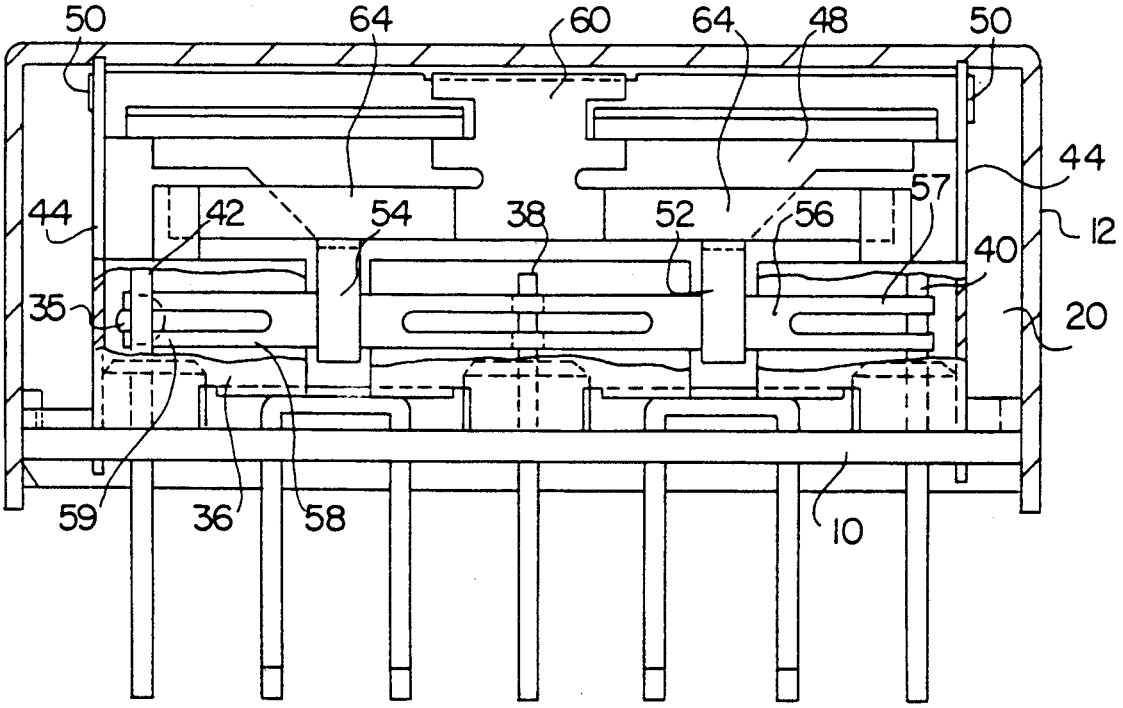
FIG. 2 is a longitudinal sectional view of the first embodiment.
Figure 3:
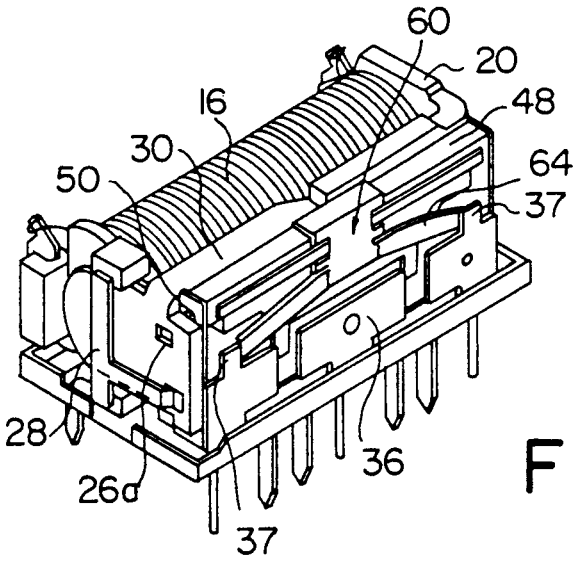
FIG. 3 is a perspective view of the first embodiment with its cover removed.
Figure 4:
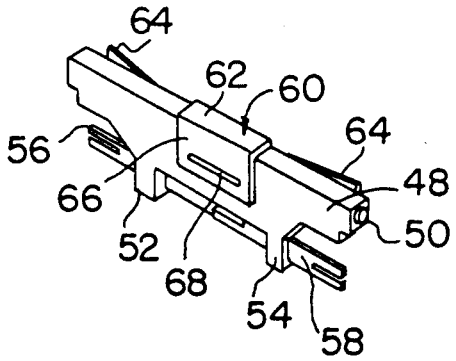
FIG. 4 is a perspective view of the moveable contact carrier of the first embodiment.

The moveable contact carrier 48 is provided with a pair of arms 52 and 54 depending therefrom into the interior of the shield case 36. Each of the depending arms 52 and 54 of the moveable contact carrier 48 carries a moveable contact piece 56 or 58 consisting of an electroconductive strip member having bifurcated parts 57 or 59 one either end thereof. As shown in FIGS. 1 and 4, the moveable contact pieces 56 and 58 are offset from each other in the direction of the swinging motion of the moveable contact carrier 48. Thus, one of the moveable contact pieces 58 is placed between the ground contacts 35 of the shield case 36 on one side and the fixed contact members 38 and 42 on the other side while the other moveable contact piece 56 is placed between the ground contacts 34 of the shield case 36 on one side and the fixed contact members 38 and 40 on the other side.

A return spring assembly 60 is fitted upon a central part of the upper end of the moveable contact carrier 48. This return spring assembly 60 comprises a spring retainer 62 having a C shaped cross section and is elastically fitted upon the central part of the plate-like upper end of the moveable contact carrier 48, a pair of leaf springs 64 extending laterally from one of the side walls 61 of the spring retainer 62, and a ridge shaped projection 68, extending laterally and projecting away from the moveable contact carrier 48, formed in the other side wall 66 of the spring retainer 62. The free ends of the leaf springs 64 abut upright tangs 37 provided in one of the side walls of the shield case 36 remote from the solenoid assembly, thereby urging the moveable contact carrier 48 towards the solenoid assembly. As a result, under normal condition, the moveable contact piece 56 is kept away from the ground contacts 34 and is in contact with the common fixed contact member 38 and the normally closed contact member 40 while the other moveable contact 58 is kept away from the normally open contact member 42 and the common fixed contact member 38 and is in contact with the ground contacts 35.

The ridge shaped projection 68 opposes the actuating end 32 of the extension arm 30 so that the actuating end 32 may push the projection 68 when the armature 24 is attracted to the opposing end portion 18*a* of the iron core 18 around its pivoted end. Since the projection 68 is made of metallic material, the wear of the moveable contact carrier 48 can be avoided. Further, generation of powder of insulating material is also prevented and poor contact in the contact mechanism due to intrusion such foreign matters may be prevented. Further, since the contact between the actuating end 32 of the extension arm 30 and the moveable contact carrier 48 can be achieved through a small area of contact, and the friction therebetween can be avoided. This contributes to the improvement of the reliability and the sensitivity of the electromagnetic relay.

Now the operation of this embodiment is described in the following primarily with reference to FIGS. 1 through 7.

When the electromagnetic solenoid 16 is not energized and the iron core 18 is therefore not magnetized, the armature 24 and the moveable contact carrier 48 are at their neutral positions by the spring forces of the return spring 28 and the leaf springs 64. In other words, the moveable contact piece 56 is in contact with the neutral fixed contact member 38 and the normally closed fixed contact member 40 so as to form a conductive path therebetween, and the other moveable contact member 58 is kept away from the neutral fixed contact member 38 and the normally open fixed contact member 42 and is in contact with the ground contacts 35 provided in the internal surface of the shield case 36.

Conversely, when the electromagnetic solenoid 16 is energized and the iron core 18 is therefore magnetized, the armature 24 is magnetically attracted to the opposing end portion 18*a* of the iron core 18, and this causes a pivotal motion of the armature 24 in the direction indicated by the arrow A in FIG. 1 against the spring force of the return spring 28 around the center of rotation located at the hinge portion consisting of the hinge projections 22*a* and 22*b* and the hinge hole 26*a* and the hinge notch 26*b*. This pivotal movement of the armature 24 causes the actuating end portion 32 to apply a pressure to the ridge shaped projection 68 provided in the return spring assembly 60, and this pressure causes the pivotal movement of the moveable contact carrier 48 against the spring force of the leaf springs 64 around the central axial line of the axial projections 50. As a result of this rotary movement of the moveable contact carrier 48, the moveable contact piece 56 moves away from the neutral fixed contact member 38 and the normally closed fixed contact member 40 and contacts the ground contacts 34 provided inside the shield case 36 while the other moveable contact piece 58 moves away from the ground contacts 35 and comes into contact with the neutral fixed contact member 38 and the normally open fixed contact member 42 so as to form a conductive path therebetween.

According to this embodiment, since the ground contacts 34 and 35 have a hemispherical shape and the opposing parts the moveable contact pieces 56 and 58 consist of the bifurcated parts 57 and 59, contacts between them are achieved as double point contacts as shown in FIG. 12. Therefore, both reliability of the contacts and sufficient contact pressures can be achieved at the same time.

Further, since the extension arm 30 can move in the space defined by the receded side surface 20*e* and the lateral notch 20*b* of the yoke 20, the extension arm 30 would not protrude from the external contour or the profile of the solenoid assembly or, in particular the yoke 20 thereof, the overall size reduction can be achieved. On the other hand, since the depth of the notch 20*b* is minimized, the reduction in the mechanism strength and the magnetically effective cross sectional area of the yoke 20 are not significantly diminished.

Since the moveable contact carrier 48 is pivotally supported in the manner of a lever so that the displacement of the projection 68 caused by pressure from the actuating end 32 of the extension arm 30 is magnified as a displacement of the arms 52 and 54 carrying the moveable contact pieces 56 and 58. Thus, since the pivotal movement of the armature 24 is first magnified by the extension arm 32 at the actuating end 32 thereof, and is then further magnified by the lever action of the moveable contact carrier 48, an extremely large factor of magnification can be achieved as a whole without increasing the overall size of the electromagnetic relay as compared with similar conventional electromagnetic relays. Therefore, according to the present embodiment, it is possible to obtain a strong magnetic attracting force by minimizing the magnetic gap between the armature 24 and the opposing end 18*a* of the iron core 18*a*, and to achieve a large displacement at the contact mechanism. Thus, the reliability of the contact mechanism may be improved.

FIGS. 15 through 17 show an alternate embodiment of the shield case 130 according to the present invention. This shield case 130 is made of brass plate or other similar material bent into an elongated rectangular box having an upright side wall around it, an open top 136, and a pair of upright pieces 131 on either longitudinal end thereof. The upright pieces 131 are provided with pivot holes 132 aligned on a common axial line, and the side wall is provided with ground contacts 133 and 144 and tangs 134 for engaging the free ends the leaf springs 64 in the same manner as the shield case 36 of the previous embodiment. The bottom wall of the shield case 130 is provided with three openings 137 for receiving corresponding projections provided in the base 10 around the fixed contact members 38, 40 and 42, and four smaller openings 138 for receiving ground terminal pieces 145 extending from a ground terminal unit 140. The ground terminal unit 140 is provided with a base end portion 142 which comprises a pair of base walls 143 connecting two adjoining ground terminal pieces 145, a central wall 142 which is offset from the base walls 143 by short walls 142*a* extending perpendicularly to the base walls 143 and the central wall 142 so as to connect them, and a pair of additional short walls 143*a* which also perpendicularly extend to the outer ends of the base walls 143 in the opposite direction to the short walls 142*a* extending perpendicularly from the inner ends of the base walls 143.

Thus according to this embodiment, the shield case 130 can be constructed from two pieces each of which is simple in structure so as to eliminate any possibility of unfavorable thermal deformation and to simplify the manufacture and assembly of the shield case. Further, since the base ends of the fixed contact members 38, 40 and 42 are surrounded by the short walls 142*a* and 143*a*, a better isolation capability may be achieved.

Figure 18:
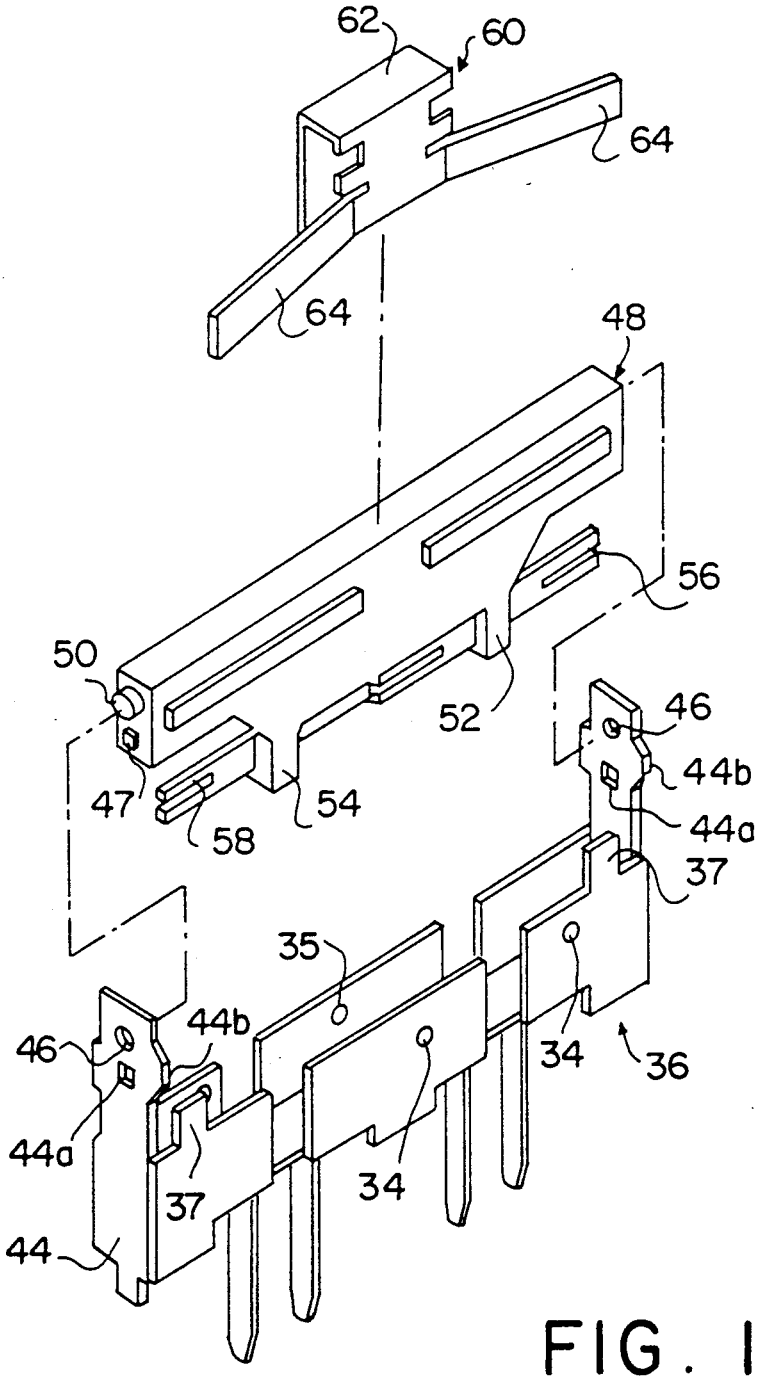
FIG. 18 is an enlarged exploded perspective view of an alternate embodiment of the contact mechanism according to the present invention.

FIG. 18 shows an alternate embodiment of the contact mechanism according to the present invention. According to the previously described embodiment, since the projections 50 had to be snap fitted into the corresponding pivot holes 46 of the upright pieces 44, it is necessary to keep the upright pieces 44 away from each other before the projections 50 may be placed between the upright pieces 44 for fitting the projections 50 into the pivot holes 44*a*, this may cause some efficiency problems during the assembly work.

According to the present embodiment, the moveable contact carrier 48 is provided with pair of rectangular projections 47 each located immediately under the axial projections 50 and provided with a tapering surface facing downward, and corresponding rectangular holes 44*a* are provided in the upright pieces 44 immediately below the pivot holes 46. To compensate for the reduction in the mechanical strength of the upright pieces 44 due to the provision of the rectangular holes 44*a*, the upright pieces 44 are made broader near the rectangular holes 44*a* as indicated by numeral 44*b*.

In snap fitting the moveable contact carrier 48 into the shield case 4B, as the moveable contact carrier 48 is pushed into the shield case 36, the rectangular projections 47 push the upright pieces 44 away from each other with their tapering surfaces. Since the distance between the axial projections 50 and the rectangular projections 47 is slightly less than the distance between the pivot holes 46 and the rectangular holes 44*a*, the projections 50 can fit into the pivot holes 46 before the rectangular projections 47 fit into the rectangular holes 44*a*. The rectangular holes 44*a* are substantially larger than the rectangular projections 47.

Therefore, when the moveable contact carrier 48 is pushed into the shield case 36 making use of the tapered surfaces of the rectangular projections 47, the upright pieces 44 are pushed apart and the axial projections 50 can be placed between the upright pieces 44 without requiring any additional means for pushing the upright pieces 44 apart. As the moveable contact carrier 48 is pushed further into the shield case 36, the axial projections 50 first fit into the pivot holes 46 followed by the fitting of the rectangular projections 47 into the rectangular holes 44*a*. Since the rectangular holes 44*a* are sufficiently larger than the rectangular projections 47, the moveable contact carrier 48 can pivot around the axial projections 50 received in the pivot holes 46 in the same way as in the previous embodiment.

FIGS. 19 and 20 illustrate an alternate embodiment of the return spring assembly for the moveable contact carrier 48. According to this embodiment, the upper wall 72 of the spring retainer is roof-top shaped, and the lower end of the front wall 71 adjoining the base ends of the leaf springs 74 is provided with a guide tang 73. This return spring assembly 70 can be formed by using a die illustrated in FIG. 21 having a roof-top shaped top part and a narrowing base end.

According to this embodiment, since the guide tang 73 abuts a corner of the end surface of the moveable contact carrier 48, even when the width L1 of the opening end of the return spring assembly 70 is narrower than the thickness L2 of the moveable contact carrier 48, simply by pushing the upper end of the return spring assembly 70, it is possible to fit the return spring assembly upon the upper end of the moveable contact carrier 48.

Thus, according to this embodiment, the assembly process is simplified, and the reliability of attachment between the return spring assembly 70 and the moveable contact carrier 48 can be improved.

What we claim is:

1. An electromagnetic relay, comprising:

a electromagnet consisting of an iron core and a solenoid wound thereon;

a yoke extending in parallel with said electromagnet and attached to one end of said iron core;

an armature pivotally attached to a part of said yoke adjacent to another end of said iron core at its base end;

a fixed contact unit provided adjacent to said electromagnet;

a movable contact carrier pivotally supported on each end by an axial projection along a pivot axis substantially parallel to said iron core, said movable contact carrier having at least one movable contact member substantially parallel to said pivot axis;

wherein at least one pair of fixed contact members is provided in said fixed contact unit and aligned along an axis parallel to said pivot axis;

an extension arm extending from said armature and having a free end adapted to abut an actuation point of said movable contact carrier located between said pivot axis and said movable contact member carried thereby;

said movable contact member being adapted to come into contact with and move apart from said pair of fixed contact members provided in said fixed contact unit by pivotally moving said movable contact carrier.

2. An electromagnetic relay according to claim 1, wherein said extension arm extends from a side end of said armature.

3. An electromagnetic relay according to claim 1, wherein said moveable contact carrier is pivotally supported by a shield case for said fixed contact member and said moveable contact member.

4. An electromagnetic relay according to claim 3, wherein said moveable contact carrier is provided with a return spring assembly comprising a spring retainer adapted to be fitted upon an end portion of said moveable contact carrier adjacent to its pivotal center line, and a leaf spring piece extending therefrom and abutting a part of said shield case.

5. An electromagnetic relay according to claim 1, wherein said yoke is provided with a pair of cavities adjacent to longitudinal end portions of said solenoid.

6. An electromagnetic relay according to claim 3, wherein said shield case consists of a outer casing having a surrounding wall, and a plurality of ground terminal pieces which are joined at their base ends by vertical wall portions, said ground terminal pieces being passed through openings provided in the bottom wall of said shield case.

7. An electromagnetic relay, comprising:

a electromagnet consisting of an iron core and a solenoid wound thereon;

a yoke extending in parallel with said electromagnet and attached to one end of said iron core;

an armature pivotally attached to a part of said yoke adjacent to another end of said iron core at its base end;

a fixed contact unit provided adjacent to said electromagnet;

an pivotally supported movable contact carrier; and an extension arm having a horizontal part extending from a side end of said armature in parallel with said electromagnet, and a vertical portion extending laterally from a free end of said horizontal portion toward said electromagnet, said vertical portion having a free end adapted to abut an actuation point of said movable contact carrier located between its pivoted point and movable contact piece carried thereby and provided on a side of said yoke opposite to said iron core, said yoke being provided with a notch extending from a side end thereof so as to accommodate said vertical portion of said extension arm therein without interfering therewith; and said movable contact member being adapted to cooperate with a fixed contact member in said fixed contact unit.

8. An electromagnetic relay according to claim 7, wherein said yoke is provided with a cut away portion which is narrower than the other part of the yoke adjacent thereto so as to accommodate said horizontal part therein without interfering therewith.

9. An electromagnetic relay, comprising:

a electromagnet consisting of an iron core and a solenoid wound thereon;

a yoke extending in parallel with said electromagnet and attached to one end of said iron core;

an armature pivotally attached to a part of said yoke adjacent to another end of said iron core at its base end;

a fixed contact unit provided adjacent to said electromagnet, said fixed contact unit having a fixed contact member;

a movable contact carrier having a movable contact member, said movable contact carrier being pivotally supported by a shield case for said movable contact member and said fixed contact member;

an extension arm extending from said armature and having a free end adapted to abut an actuation point of said movable contact carrier located between its pivoted point and said movable contact member carried thereby;

a return spring assembly for said contact carrier having a spring retainer adapted to be fitted upon an end portion of said movable contact carrier adjacent to its pivotal center line and having a projection adapted to be engaged by said actuating end of said extension arm, and a leaf spring piece extending therefrom and abutting a part of said shield case;

said movable contact member being adapted to cooperate with said fixed contact member provided in said fixed contact unit.

10. An electromagnetic relay according to claim 9, wherein a hemispherical contact is formed in a side wall of said shield case, and said movable contact piece is provided with a bifurcated end to which is adapted to contact said hemispherical contact at two points.

11. An electromagnetic relay according to claim 10 wherein said shield case is provided with a tang which is adapted to be fitted into a corresponding hole provided in said yoke, and a terminal piece which is adapted to be passed through a base and fixedly secured thereto.

12. An electromagnetic relay according to claim 11, wherein said solenoid is provided with a pair of coil wire end terminals which are adapted to be passed through said base and fixedly secured thereto, and are provided with engagement portions for holding said electromagnet upon said base.

13. An electromagnetic relay, comprising:

a electromagnet consisting of an iron core and a solenoid wound thereon;

a yoke extending in parallel with said electromagnet and attached to one end of said iron core;

an armature pivotally attached to a part of said yoke adjacent to another end of said iron core at its base end;

a fixed contact unit provided adjacent to said electromagnet, said fixed contact unit having a fixed contact member;

a movable contact carrier having a movable contact member, said movable contact carrier being pivotally supported by a shield case for said movable contact member and said fixed contact member, said shield case comprising a pair of upright pieces having pivot holes therein for receiving projection provided in lateral ends of said movable contact carrier in a pivotal manner, and said movable contact carrier in additionally provided with guide projections for pushing apart said upright pieces while said upright pieces are provided with openings adjacent to said pivot holes for receiving said guide projections without interfering pivotal movement of said movable contact carrier;

an extension arm extending from said armature and having a free end adapted to abut an actuation point of said movable contact carrier located between its pivoted point and said movable contact member carried thereby;

said movable contact member being adapted to cooperate with said fixed contact member provided in said fixed contact unit.

14. An electromagnetic relay, comprising:

a electromagnet consisting of an iron core and a solenoid wound thereon;

a yoke extending in parallel with said electromagnet and attached to one end of said iron core;

an armature pivotally attached to a part of said yoke adjacent to another end of said iron core at its base end;

a fixed contact unit provided adjacent to said electromagnet, said fixed contact unit having a fixed contact member;

a movable contact carrier having a movable contact member, said movable contact carrier being pivotally supported by a shield case for said movable contact member and said fixed contact member;

an extension arm extending from said armature and having a free end adapted to abut an actuation point of said movable contact carrier located between its pivoted point and said movable contact member carried thereby;

a return spring assembly for said contact carrier having a C-shaped spring retainer adapted to be fitted upon an end portion of a planar part of said movable contact carrier adjacent to its pivotal center line, said C-shaped spring retainer being provided with a roof-top shaped top wall, and an opening defined between two side walls of said spring retainer being narrower than the thickness of a corresponding end portion of said planar part of said movable contact carrier on which said spring retainer is to be fitted, and said spring assembly also having a leaf spring piece extending therefrom and abutting a part of said shield case;

said movable contact member being adapted to cooperate with said fixed contact member provided in said fixed contact unit.

* * * * *